US005401555A

United States Patent [19]

Yamakita

[11] Patent Number: 5,401,555

[45] Date of Patent: Mar. 28, 1995

[54] CLOTH

[75] Inventor: Yoshimichi Yamakita, Toyama, Japan

[73] Assignee: Yoshida Kogyo K.K., Tokyo, Japan

[21] Appl. No.: 32,293

[22] Filed: Mar. 17, 1993

[30] Foreign Application Priority Data

Apr. 1, 1992 [JP] Japan ..... 4-109365

[51] Int. Cl.[6] ..... B32B 3/06; A41H 37/00; A44B 1/04; A44B 11/25

[52] U.S. Cl. ..... 428/99; 428/102; 428/103; 428/104; 156/66; 24/381; 24/387; 24/391; 139/384 B; 8/478; 8/480; 8/481; 8/529

[58] Field of Search ..... 428/99, 102, 103, 104, 428/258, 259, 392; 156/66; 24/381, 387, 391; 8/151, 158, 477, 561, 478, 480, 481, 488, 529; 139/384 B

[56] References Cited

U.S. PATENT DOCUMENTS

| | | | |
|---|---|---|---|
| 4,499,927 | 2/1985 | Borel | 139/413 |
| 4,595,627 | 6/1986 | Steinman | 428/258 |
| 5,172,456 | 12/1992 | Samberg et al. | 428/258 |

FOREIGN PATENT DOCUMENTS

| | | |
|---|---|---|
| 2655873 | 6/1978 | Germany . |
| 62-110945 | 5/1987 | Japan . |
| 609946 | 11/1948 | United Kingdom . |
| 1041240 | 9/1966 | United Kingdom . |
| 1590495 | 9/1990 | U.S.S.R. . |

*Primary Examiner*—George F. Lesmes
*Assistant Examiner*—Kathryne E. Shelborne

[57] ABSTRACT

A cloth composed of first and second threads, the first threads being dyeable by a first dye and being much more exposed on a front surface of the cloth than a back surface thereof, the second threads being not dyeable by said first dye and dyeable by a second dye and being much more exposed on the back surface than the front surface.

5 Claims, 2 Drawing Sheets

CLOTH

BACKGROUND OF THE INVENTION

1. Field of the Invention

The present invention relates to a cloth for ribbons, scarves or slide fasteners which can have patterns dyed onto it.

2. Description of the Related Art

Conventional cloth for ribbons, scarves or slide fasteners is usually dyed the same color on both sides.

The cloth used with these kinds of garments is considered to be decorative. The fact that conventional slide fastener tape used in sweaters, for example, is the same color on both sides will therefore cause the following two problems. Although sweaters, for example, may have slide fasteners which go all the way up to the collar, people will often wear them with the slide fastener not fully done up and the collar open. This means that the color of the neck cannot be varied, although whether or not this is a hindrance depends on the personal preference of the wearer. Also, this kind of garment can also often be worn either way out. However, the selection of colors for the garment is greatly restricted by the fact that whichever way out the garment is worn, the color of the slide fastener tape will remain the same.

SUMMARY OF THE INVENTION

Therefore, an object of the present invention is to provide a cloth which can be dyed a different color on each side.

According to the present invention, there is provided a cloth composed of first and second threads, said first thread being dyeable by a first dye and being much more exposed on a front surface of the cloth than a back surface thereof, said second thread being not dyeable by said first dye and able to be dyed by a second dye and being much more exposed on the back surface than the front surface.

This cloth can then be made suitable for use as a slide fastener tape. Further, the slide fastener tape may has a belt-shaped portion in which the second thread is much more exposed on a part of the front surface than the back surface longitudinally thereof.

DETAILED DESCRIPTION

Figure 1:
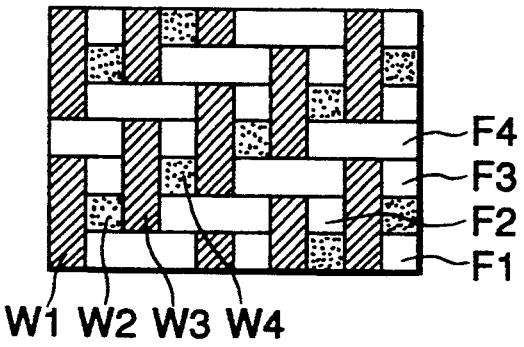
FIG. 1 is a view describing the woven structure of the cloth in this invention.
Figure 2:
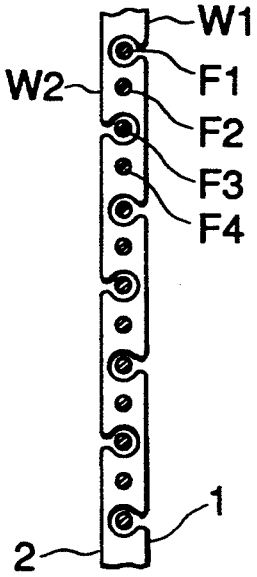
FIG. 2 is a large-scale sectional view of the arrangement of individual threads in the cloth.

A more detailed description of this invention will now be given by referring to one part of the twill woven structure in FIGS. 1 and 2. A warp thread W1 indicated by the hatching lines runs over weft threads F1, F2 and F3 and then runs under the weft thread F4. Next, the warp thread W2 indicated by the dot pattern runs under the weft thread F1, over the weft thread F2 and then under weft threads F3 and F4. The warp thread W3 then runs under the weft thread F1 and over weft threads F2, F3 and F4. Then, the warp thread W4 runs under weft threads F1 and F2, over the weft thread F3 and under the weft thread F4.

The warp threads W1 and W3 are made of the same thread and are out of step with each other by one pitch. The warp threads W2 and W4 are also made of the same thread although this thread is different to the thread used for the warp threads W1 and W3 and are also out of step with each other by one pitch. As the warp threads W1 and W3 are more prominent on the first side and the warp threads W2 and W4 are more prominent on the second side, the cloth has two distinct sides, and is therefore reversible.

In this woven structure the first threads 1 which make up every second warp thread W1 and W3 are made from rayon and the second threads 2 which make up every other second warp thread W2 and W4 are made from polyester. The weft threads F1, F2, F3 and F4 are all made from polyester.

This example takes advantage of the properties of the materials rayon and polyester. If using dispersible dyes, for example, one kind of dye could be used which would dye the polyester threads but would not dye the rayon threads. These rayon threads could then be dyed using a further kind of dye. When weaving, a choice could also then be made between using a dyeable fiber thread and a non dyeable fiber thread for the first system, thus giving two distinct kinds of thread.

There are many well known dyes by which a pattern could then be dyed onto the rayon. These include direct dyes, basic dyes, vat dyes, sulfide dyes and sulfide vat dyes.

Figure 3:
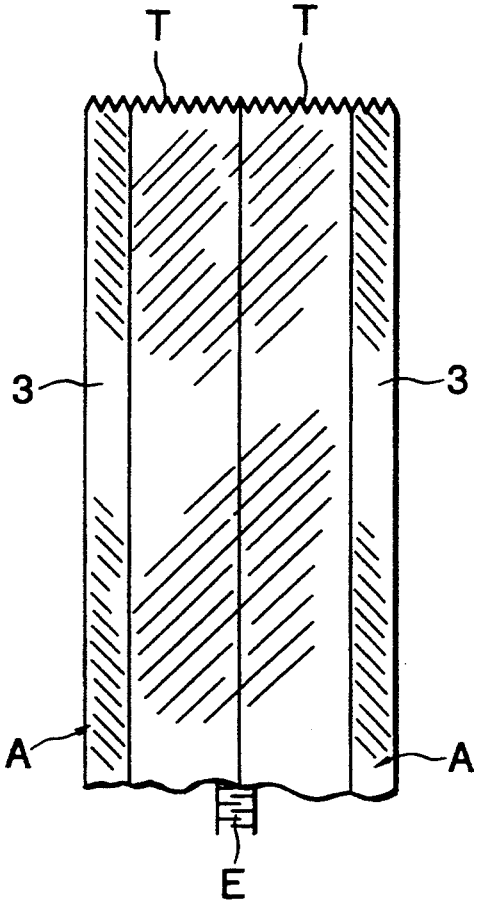
FIG. 3 is a front view of the cloth employed as slide fastener tape.
Figure 4:
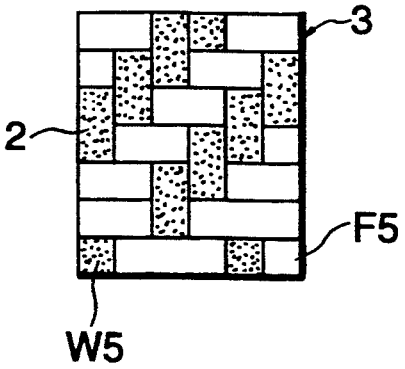
FIG. 4 is view describing the woven structure of the portion A in FIG. 3.

FIG. 3 shows an example of a slide fastener. Here, a belt shaped portion 3 runs down both outside edges of the slide fastener tape T, with E being fastener elements. This belt shaped portion 3 is woven using the system shown in FIG. 4 from a warp thread W5 and a weft thread F5, which are weaved from polyester having the same material properties as the aforementioned second thread 2. The material used in this belt shaped portion 3 could also be used form a pattern on, for example, scarves or ribbons.

If the cloth formed using the above method is now soaked in a bath of, for example, dispersible dye, only the second threads 2 made from polyester will be dyed. As these second threads 2 are more prominent on the second side, only this second side, along with the belt shaped portion of the first side in which these second threads are also prominent, will be dyed. The first threads 1 which are more prominent on the first side will remain their original color. This first surface could then be dyed using the spray or ink jet dying methods, or could have a pattern put onto it by using the ink jet dying method.

In the cloth in the present invention there are first threads 1 which can only be dyed by using a dye for a first system of dying, and second threads 2 which can be dyed using a dye for a second dying system but cannot be dyed by the dye from the first system of dying. These first threads are more prominent on the first side of the cloth while the second threads are more prominent on the second side of the cloth. This system differs from other systems in that the dying process is carried out twice, but rather than the whole of the cloth being dyed in one go, each side of the cloth can actually be dyed to a desired color. With, for example, a reversible sweater, either side of any slide fastener tape used could be dyed so as either side of the slide fastener tape would match with the color of the sweater. This would improve the quality and increase the value of any goods made.

If the cloth in this invention is used as slide fastener tape, the belt shaped portions at the edges of the first surface can act as sewing margin guides, thus making it very easy to attach.

What is claimed:

1. A woven slide fastener tape having a front surface and a back surface of different colors, comprising:

a plurality of first threads;

a plurality of second threads, said first and second threads alternating as warp threads in a weave across a width of the cloth, said first threads being dyed by a first dye and being exposed to a greater extent on the front surface of the tape than the back surface thereof, said second threads being resistant to dying by said first dye and being dyed by a second dye and being exposed to a greater extent on the back surface than the front surface.

2. The slide fastener tape according to claim 1, wherein said slide fastener tape comprises a longitudinal belt-shape portion wherein said second threads are exposed to a greater extent on part of the front surface longitudinally thereof.

3. The slide fastener tape according to claim 2, wherein said first threads and said second threads alternate in position and comprise two to one weaving patterns.

4. The cloth according to claim 1, wherein said plurality of first threads and said plurality of second threads are warp threads having a three to one weaving pattern.

5. The cloth according to claim 1, wherein said first threads comprise rayon and said second threads comprise polyester.

* * * * *